United States Patent [19]

Deguchi et al.

[11] Patent Number: 4,497,893

[45] Date of Patent: Feb. 5, 1985

[54] SILVER HALIDE COLOR REVERSAL PHOTOGRAPHIC MATERIAL

[75] Inventors: Naoyasu Deguchi; Koji Kameyama; Taku Nakamura, all of Kanagawa, Japan

[73] Assignee: Fuji Photo Film Co., Ltd., Kanagawa, Japan

[21] Appl. No.: 575,601

[22] Filed: Jan. 31, 1984

[30] Foreign Application Priority Data

Jan. 31, 1983 [JP] Japan ..... 58-14304

[51] Int. Cl.[3] ..... G03C 7/00; G03C 1/76

[52] U.S. Cl. ..... 430/359; 430/379; 430/383; 430/505; 430/539; 430/543; 430/546; 430/642; 430/950

[58] Field of Search ..... 430/359, 379, 383, 539, 430/543, 546, 642, 950, 505

[56] References Cited

U.S. PATENT DOCUMENTS

| | | | |
|---|---|---|---|
| 2,026,899 | 1/1936 | Kipphan | 430/359 |
| 2,272,117 | 2/1942 | Hasslacher et al. | 430/359 |
| 2,487,858 | 11/1949 | Dean et al. | 430/359 |
| 4,070,109 | 1/1978 | Ihlenfeld et al. | 430/394 |
| 4,396,709 | 8/1983 | Kameoka et al. | 430/539 |

*Primary Examiner*—J. Travis Brown

*Attorney, Agent, or Firm*—Sughrue, Mion, Zinn, Macpeak & Seas

[57] ABSTRACT

A silver halide color reversal photographic material comprising a backing layer containing both gelatin of an isoelectric point of 5.5 or more and a cationic polymer is disclosed. By utilizing the particular backing layer the color reversal photographic material has increased retouchability.

19 Claims, No Drawings

SILVER HALIDE COLOR REVERSAL PHOTOGRAPHIC MATERIAL

FIELD OF THE INVENTION

The present invention relates to a silver halide color reversal photographic material (which is hereafter referred to as a color reversal photographic material) and, more particularly, to a color reversal photographic material which has a backing layer whose retouchability is improved on.

BACKGROUND OF THE INVENTION

As is universally known, a color reversal photographic material comprises a support having thereon at least one blue-sensitive silver halide emulsion layer, at least one green-sensitive silver halide emulsion layer and at least one red-sensitive silver halide emulsion layer, in which layers a yellow coupler, a magenta coupler and a cyan coupler are incorporated respectively, and produces a color image when subjected to reversal development. The color reversal photographic material has been prevailingly used as an original for color printing and as that for general amateurs. The color reversal photographic material is described, for example, in U.S. Pat. Nos. 4,388,401, 4,301,242, 3,728,121 and 3,505,068.

When color reversal photographic materials are employed for originals of color printing, color originals obtained after reversal processing are sometimes subjected to color retouching with the aid of dyes. This color retouching treatment is called "retouch" in this art.

Retouching is frequently carried out from the side of backing layer (which is applied on the side of the support opposite to that on which silver halide emulsion layers are applied) of color reversal photographic materials. Therein, water soluble anionic dyes are generally employed as the retouching dyes.

It is essential to the retouchability that water soluble dyes used have sufficient affinities to the binder of the backing layer and therethrough they can spread with adequate densities.

However, satisfactory retouching densities have not yet been obtained by retouching conventional color reversal photographic materials using water soluble anionic dyes, and retouchabilities of conventional color reversal photographic materials were insufficient.

SUMMARY OF THE INVENTION

Therefore, a primary object of the present invention is to provide a color reversal photographic material having improved retouchability.

The above-described object is effectively attained by a silver halide color reversal photographic material which comprises a support having on the one side thereof a blue-sensitive silver halide emulsion layer, a green-sensitive silver halide emulsion layer and a red-sensitive silver halide emulsion layer, and on the other side thereof a gelatin-containing backing layer, said backing layer containing a gelatin of an isoelectric point of 5.5 or more and further containing a cationic polymer.

DETAILED DESCRIPTION OF THE INVENTION

Preferred examples of gelatins of an isoelectric point of 5.5 or more which are to be employed in the present invention are so-called acid-processed gelatins.

The acid-processed gelatins are different in their preparation processes from lime-processed gelatins, which are usually used in the art.

Details of preparation processes, properties and so on of the acid-processed gelatins are described in Arthur Veis, *The Macromolecular Chemistry of Gelatin* (published by Academic Press) pages 186–192.

Gelatins which can be employed in the present invention are those of an isoelectric point of 5.5 or more, preferably 6.5 or more, and particularly preferably ranging from 7.0 to 9.5.

A preferred coverage of the gelatin of an isoelectric point of 5.5 or more in the present invention is 2.0 to 20 g per square meter, particularly 4.0 to 15 g per square meter.

Preferred examples of the cationic polymer to be employed in the present invention are those having a pKa value of 5.0 or more.

Particularly preferred examples of cationic polymers employed in the present invention include polymers having the recurring units represented by the following general formula (I) or (II):

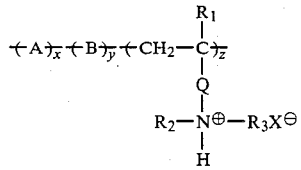

(I)

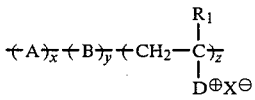

(II)

wherein A represents a monomer unit obtained by copolymerizing copolymerizable monomers having at least two copolymerizable ethylenically unsaturated groups wherein at least one of the groups forms side chain of the monomer; B represents a monomer unit obtained by copolymerizing copolymerizable ethylenically unsaturated monomers; and $D^{\oplus}$ represents a 5- or 6-membered heterocyclic group containing one or two nitrogen atoms wherein the nitrogen atom is charged positively, which may be substituted with an alkyl group such as a methyl group.

Preferred examples of monomer for constituting the monomer unit A in the particularly preferred cationic polymers of the present invention include divinylbenzene, ethylene glycol dimethacrylate, diethylene glycol dimethacrylate, triethylene glycol dimethacrylate, ethylene glycol diacrylate, diethylene glycol diacrylate, 1,6-hexanediol diacrylate, neopentyl glycol dimethacylate, tetramethylene glycol dimethacrylate and the like. Among these monomers, divinylbenzene and ethylene glycol dimethacrylate are particularly preferred.

Preferred examples of monomer for constituting the monomer unit B in the particularly preferred cationic polymers of the present invention include ethylene, propylene, 1-butene, isobutene, styrene, α-methylstyrene, vinyltoluene, monoethylenically unsaturated esters of fatty acids (e.g. vinyl acetate, allyl acetate, etc.), esters of ethylenically unsaturated mono- or di-carboxylic acids (e.g., methylmethacrylate, ethylmethacrylate, n-butylmethacrylate, n-hexylmethacrylate, cyclohexylmethacrylate, benzylmethacrylate, n-butylacrylate, n-hexylacrylate, 2-ethylhexylacrylate, etc.), monoethylenically unsaturated compounds (e.g., acryloritrile), dienes (e.g., butadiene, isoprene, etc.) and so on. Among these monomers, styrene, n-butylmethacrylate and cyclohexylmethacrylate are particularly preferred.

B may contain two or more of monomer units obtained by copolymerizing the above-described monomers.

In the foregoing general formula (II), heterocyclyl groups represented by D⊕ are

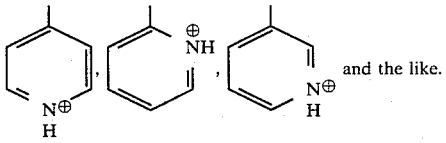

In the foregoing general formulae, $R_1$ represents a hydrogen atom or a lower alkyl group containing 1 to 6 carbon atoms (e.g., a methyl group, an ethyl group, an n-propyl group, an n-butyl group, an n-amyl group, an n-hexyl group, etc.). Among these substituents, a hydrogen atom and a methyl group are particularly preferred.

Q represents an alkylene group containing 1 to 12 carbon atoms (e.g., a methylene group, the group of formula, $-(CH_2)_6-$, etc.), a phenylene group, an aralkylene group containing 7 to 12 carbon atoms

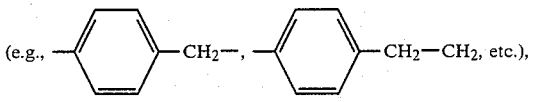

or a group of formula,

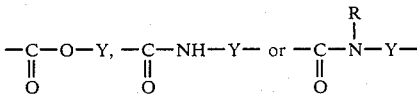

(wherein Y represents an alkylene group containing 1 to 6 carbon atoms or an aralkylene group containing 7 to 12 carbon atoms; and R represents an alkyl group containing 1 to 6 carbon atoms.)

$R_2$ and $R_3$, which may represent the same or different, each represents an unsubstituted or substituted alkyl group containing 1 to 20 carbon atoms or an unsubstituted or substituted aralkyl group containing 7 to 20 carbon atoms.

Moreover, $R_2$ and $R_3$ may combine with each other to form a 5- or 6-membered ring structure together with the nitrogen atom.

Preferred examples of unsubstituted alkyl groups represented by $R_2$ or $R_3$ include a methyl group, an ethyl group, an n-propyl group, an isopropyl group, an n-butyl group, an isobutyl group, a t-butyl group, an n-amyl group, an isoamyl group, an n-hexyl group, a cyclohexyl group, an n-heptyl group, an n-octyl group, a 2-ethylhexyl group, an n-nonyl group, an n-decyl group, an n-dodecyl group and so on. Among these groups, alkyl groups containing 1 to 6 carbon atoms are particularly preferred.

Preferred examples of substituted alkyl groups represented by $R_2$ or $R_3$ include alkoxyalkyl groups (e.g., a methoxymethyl group, a methoxyethyl group, a methoxybutyl group, an ethoxyethyl group, an ethoxypropyl group, an ethoxybutyl group, a butoxyethyl group, a butoxypropyl group, a butoxybutyl group, a vinyloxyethyl group, etc.), cyanoalkyl groups (e.g., a 2-cyanoethyl group, a 3-cyanopropyl group, a 4-cyanobutyl group, etc.), halogenated alkyl groups (e.g., a 2-fluoroethyl group, a 2-chloroethyl group, a 3-fluoropropyl group, etc.), alkoxycarbonylalkyl groups (e.g., an ethoxycarbonylmethyl group, etc.), an allyl group, a 2-butenyl group, a propargyl group and so on.

Preferred examples of aralkyl groups represented by $R_2$ or $R_3$ include unsubstituted aralkyl groups such as a benzyl group, a phenetyl group, a diphenylmethyl group, a naphthylmethyl group, etc.; and substituted aralkyl groups such as an alkylaralkyl groups (e.g., a 4-methylbenzyl group, a 2,5-dimethylbenzyl group, a 4-isopropylbenzyl group, etc.), alkoxyaralkyl groups (e.g., a 4-methoxybenzyl group, a 4-ethoxybenzyl group, a 4-(4-methoxyphenyl)benzyl group, etc.), cyanoalkyl groups (e.g., a 4-cyanobenzyl group, a 4-(4-cyanophenyl)benzyl group, etc.), perfluoroalkoxy aralkyl groups (e.g., a 4-pentafluoropropoxybenzyl group, a 4-undecafluorohexyloxybenzyl group, etc.), halogenated aralkyl groups (e.g., a 4-chlorobenzyl group, a 4-bromobenzyl group, a 3-chlorobenzyl group, a 4-(4-chlorophenyl)benzyl group, a 4-(4-bromophenyl)benzyl group, etc.) and so on. Among these groups, aralkyl groups containing 7 to 14 carbon atoms are more preferred, and benzyl groups are particularly preferred.

Preferred examples of the ring structure which $R_2$ and $R_3$ form together with the nitrogen atom by combining with one another include pyrrolidine, piperidine, morpholine and the like.

X⊖ represents an anion, with preferred examples including halogen ions (e.g., a chlorine ion, a bromine ion, etc.), alkyl- or aryl-sulfonic acid ions (e.g., a methanesulfonic acid ion, a benzenesulfonic acid ion, a p-toluenesulfonic acid ion, etc.), an acetic acid ion, a nitric acid ion, and so on. Among these ions, a chlorine ion, an acetic acid ion and a nitric acid ion are particularly preferred.

x represents 0 to 10 mole %, preferably 3.0 to 10.0 mole %, y represents 0 to 60 mole %, preferably 0 to 55 mole %, and z represents 30 to 99.5 mole %, preferably 40 to 97 mole %.

It is preferred that when x is not zero, the polymer of the present invention is used in the form of a polymer dispersion. The polymer dispersion is referred to these wherein the polymer of the present invention is dispersed in the form of latex.

Preferred examples of the cationic polymer preferably used in the present invention are illustrated below. However, the present invention should not be construed as being limited to the following examples.

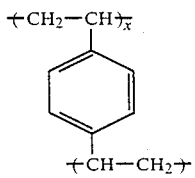

(1)

-continued
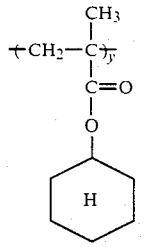
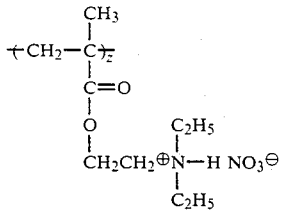
x:y:z = 4:48:48
(2)
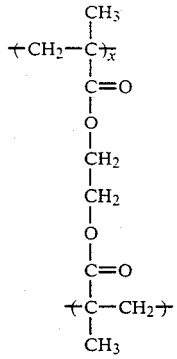
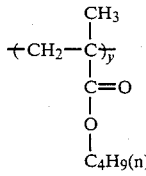
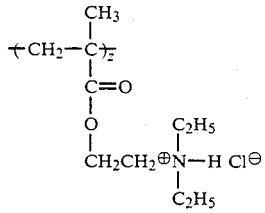
x:y:z = 4:48:48
(3)
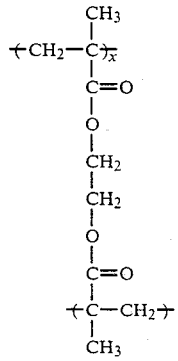
-continued
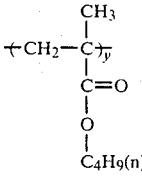
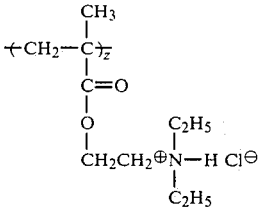
x:y:z = 5:10:85
(4)
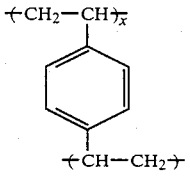
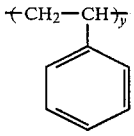
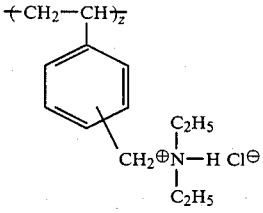
x:y:z = 4:24:72
(5)
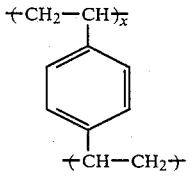
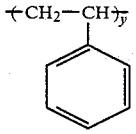
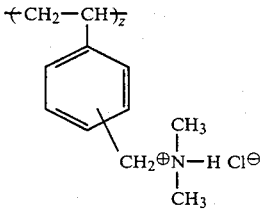
x:y:z = 4:24:72

-continued (6)

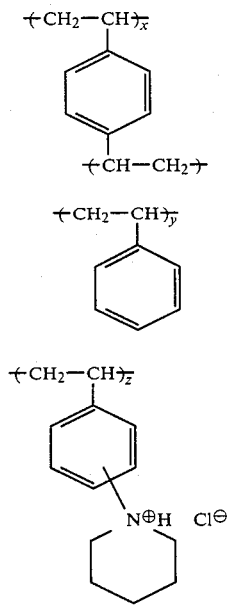

x:y:z = 5:47.5:47.5

A preferred coverage of the cationic polymer in the present invention ranges from 0.01 to 10 g per square meter, more preferably 0.05 to 5 g per square meter, and particularly 0.1 to 2 g per square meter.

Although the present invention enables improvement in the retouchability of a color reversal photographic material by providing the backing layer using a gelatin of an isoelectric point of 5.5 or above and a cationic polymer, more desirable results can be obtained when a small amount of high boiling point organic solvent is further incorporated in the backing layer.

That is, incorporation of a high boiling point organic solvent into the backing layer of the present invention contributes to strengthening adhesion power between the backing layer and a support used and therethrough can be provided practical effects.

Examples of the high boiling point organic solvent which can be used for the above-described contribution include all of those well-known in this art.

Preferred examples of high boiling point organic solvent involve alkyl esters of phthalic acid (e.g., dibutyl phthalate, dioctyl phthalate, dicyclohexyl phthalate, etc.), phosphoric acid esters (e.g., diphenyl phosphate, triphenyl phosphate, tricresyl phosphate, dioctylbutyl phosphate, trioctylphosphate, trihexyl phosphate, tricyclohexyl phosphate, etc.), citric acid esters (e.g., tributyl acetylcitrate, etc.), benzoic acid esters (e.g., octyl benzoate, etc.), alkyl amides (e.g., diethyllaurylamide, etc.), fatty acid esters (e.g., dibutoxyethyl succinate, dioctyl azelate, etc.), trimesic acid esters (e.g., butyl trimesate etc.) and so on.

An amount of a high boiling point organic solvent which can be employed in the present invention is preferably from 0.01 to 0.40 g, particularly from 0.05 to 0.30 g, per square meter.

The backing layer of the color reversal photographic material of the present invention can further contain a surface active agent, an antistatic agent, a hardener, a slipping agent, a matting agent and so on as occasion demands.

These additives do not have any particular restrictions, and for details thereof *Research Disclosure,* vol. 176, pp. 22–28 (Dec., 1978) can be referred to.

Moreover, the backing layer of the present invention need not be a single layer, and may be constructed by plural layers.

Next, a brief description of layers present on the silver halide emulsion layer side of the color reversal photographic material of the present invention will be given below.

The color reversal photographic material of the present invention is not restricted in any way in its support, the constitution of its silver halide emulsion layer (involving, e.g., compositions of silver halide emulsions, antifoggants, chemical sensitizers, spectral sensitizing dyes, color couplers, high boiling point organic solvents, ultraviolet absorbing agents, dyes, discoloration inhibitors, binders, hardeners, surface active agents, etc.), the construction of other hydrophilic colloid layers (e.g., interlayer, surface protective layer, etc.), and layer arrangement among silver halide emulsion layers and other hydrophilic colloid layers. For details thereof descriptions in *Research Disclosure,* supra, can be referred to.

For example, a preferred silver halide is silver iodobromide having an iodide content of 0 to 10 mole %, particularly 2 to 8 mole %. It does not matter what crystal forms the silver halide grains have, and the silver halide grains may have the so-called JP/shell (core/shell) type of form.

Chemical sensitization can be carried out using, for example, a sulfur sensitization process utilizing compounds containing sulfur capable of reacting with active gelatin or silver ion ( e.g., thiosulfates, thioureas, mercapto compounds, rhodanine, etc.); a reduction sensitization process utilizing reducing materials (e.g., stannous salts, amines, hydrazine derivatives, formamidine sulfinic acid, silane compounds, etc.); a noble metal sensitization process utilizing noble metal compounds (e.g., gold metal complexes and Group VIII metal complexes such as those of Pt, Ir, Pd, etc.); and so on individually or as a combination thereof.

As for antifoggants and stabilizers, those which have been well-known in this art, such as azoles (e.g., benzothiazolium salts, nitroindazoles, triazoles, benzotriazoles, and benzimidazoles, particularly those substituted with nitro groups or halogens); heterocyclic mercapto compounds (e.g., mercaptothiazoles, mercaptobenzothiazoles, mercaptobenzimidazoles, mercaptothiadiazoles, mercaptotetrazoles, particularly 1-phenyl-5-mercaptotetrazole and mercaptopyrimidines); the above-described heterocyclic mercapto compounds having water soluble groups such as a carboxyl group, a sulfo group, etc.; thioketo compounds (e.g., oxazoline thione); azaindenes (e.g., tetrazaindenes, particularly 4-hydroxy substituted (1,3,3a,7)-tetrazaindenes); benzenethiosulfonic acids; benzenesulfinic acids; and so on can be added to the silver halide emulsions.

Preferred examples of magenta couplers include 5-pyrazolone couplers, pyrazolobenzimidazole couplers, cyanoacetylcumarone couplers, open chain acylacetonitrile couplers and the like. Preferred examples of yellow couplers include acylacetoamide couplers (e.g., benzoylacetoanilides, pivaloylacetoanilides, etc.). Preferred examples of cyan couplers include phenol couplers and naphthol couplers can be added. It is to be desired that these couplers should have non-diffusibility by containing a hydrophobic group called a ballast group in their molecules. These couplers may be either two equivalent or four equivalent with respect to silver ions.

Surface active agents which can be added to the silver halide emulsions of the present invention include natural surface active agents such as saponin (steroid type); nonionic surface active agents of the alkyleneoxide type (e.g., polyethylene glycol, polyethylene glycol/polypropylene glycol condensate, polyethylene glycol alkyl ethers, polyethylene glycol alkyl aryl ethers, polyethylene glycol esters, polyethylene glycol sorbitane esters, polyalkylene glycol alkylamines or amides, addition products of silicone and polyethylene oxides, etc.), the glycidol type (e.g., alkenylsuccinic acid polyglycerides, alkylphenol polyglycerides, etc.), fatty acid esters of polyhydric alcohols, alkyl esters of sugar, and so on; anionic surface active agents containing acid groups such as a carboxylic acid group, a sulfonic acid group, a phosphoric acid group, a sulfate group, a phosphate group, etc. (e.g., alkyl carboxylates, alkyl sulfonates, alkylbenzenesulfonates, alkylnaphthalenesulfonates, alkylsulfuric acid esters, alkylphosphoric acid esters, N-acyl-N-alkyltaurine, sulfosuccinic acid esters, sulfoalkylpolyoxyethylene alkyl phenyl ethers, polyoxyethylene alkylphosphoric acid esters, etc.); amphoteric surface active agents such as amino acids, aminoalkyl sulfonic acids, aminoalkyl sulfuric acid or phosphoric acid esters, alkyl betaines, amine oxides, etc.; and cationic surface active agents such as alkylamines, aliphatic or aromatic quaternary ammonium salts, heterocyclic quaternary ammonium salts (e.g., pyridinium, imidazolium, etc.), aliphatic or heterocyclic phosphoniums, and so on.

Preferred examples of hardeners include chromium salts (e.g., chrome alum, chromium acetate, etc.), aldehydes (e.g., formaldehyde, glyoxal, glutaraldehyde, etc.), N-methylol compounds (e.g., dimethylol urea, methylol dimethylhydantoin, etc.), dioxane derivatives (e.g., 2,3-dihydroxydioxane, etc.), active vinyl-containing compounds (e.g., 1,3,5-triacryloyl-hexahydro-s-triazine, 1,3-vinylsulfonyl2-propanol, etc.), active halogen-containing compounds (e.g., 2,4-dichloro-6-hydroxy-s-triazine, etc.), halocarboxyaldehydes (e.g., mucochloric acid, mucophenoxychloric acid, etc.) and so on, and they can employed individually or as combinations thereof.

Preferred examples of ultraviolet absorbing agents include benzotriazole compounds substituted with aryl groups, 4-thiazolidone compounds, benzophenone compounds, cinnamic acid esters, butadiene compounds, benzoxazole compounds and further, ultraviolet absorbing polymers and the like. These ultraviolet absorbing agents may be fixed in the above-described hydrophilic colloid layers.

Preferred examples of discoloration inhibitors include hydroquinone derivatives, gallic acid derivatives, p-alkoxyphenols, p-oxyphenol derivatives, bisphenols and the like.

The color reversal photographic material of the present invention has on a support, such as a cellulose acetate film, a polyethylene terephthalate film or the like, at least one red-sensitive emulsion layer, at least one green-sensitive emulsion layer and at least one blue-sensitive emulsion layer. These emulsion layers may be arranged in any order as occasion demands. In general, the red-sensitive emulsion layer contains a cyan forming coupler, the green-sensitive emulsion layer contains a magenta forming coupler, and the blue-sensitive emulsion layer contains a yellow forming coupler. However, combinations other than the above-described ones can also be employed in certain circumstances.

The color reversal photographic material of the present invention need not receive any particular restriction in development processing, and all known color reversal developing methods can be suitably employed.

Examples of retouch dyes which are to be used for retouching the color reversal photographic material of the present invention after development processing include all of those which have been used as a retouching dye in this art. Preferred examples of retouch dyes include E-6 Transparency Retouch Dye (produced by Eastman Kodak Co.), PÉBÉO Retouch Dye (which is produced by PÉBÉO, Co. and the registered trade name of which is "MINIKIT"), Dye Transfer Dye (produced by Eastman Kodak, Co.), Retouch Dye (produced by RETOUCH METHOD, Co.) and so on can be advantageously used.

The invention will be explained further by the following examples but the invention shall not be limited by these examples.

EXAMPLE 1

Color reversal photographic materials (a), (b), (c) and (d) were prepared by providing on one side of their individual supports the backing layer having their respective compositions as set forth in Table 1 described below and further, by providing on the other side of the support the same layers, from the first layer to the fourteenth layer, as those of Sample A in Example 1 of Japanese Patent Application No. 175199/82 (corresponding to U.S. patent application Ser. No. 539, 241 filed on Oct. 5, 1983). These samples were subjected to color reversal development in the same manner as in Example 1 of Japanese Patent Application No. 175199/82.

After the development processings, the color reversal photographic materials were sorked in E-6 Transparency Retouch Dye diluted ten times with water for 3 minutes, and dried. The resulting densities of three colors in each sample were measured. The results obtained are shown in Table 1.

TABLE 1

| Sample | (a) | (b) | (c) | (d) |
|---|---|---|---|---|
| Gelatin | | | | |
| Sort | Lime-Processed Gelatin | Acid-Processed Gelatin | Acid-Processed Gelatin | Acid-Processed Gelatin |
| Isoelectric Point | 4.8 | 7.0 | 7.0 | 7.0 |
| Coverage (g/m$^2$) | 5.7 | 5.7 | 5.7 | 5.7 |
| Cationic Polymer* | | | | |
| Coverage (g/m$^2$) | 0 | 0 | 0.10 | 0.79 |
| Retouch Density | | | | |
| Yellow | 0.15 | 0.23 | 0.32 | 0.49 |
| Magenta | 0.08 | 0.16 | 0.26 | 0.40 |

TABLE 1-continued

| Sample | (a) | (b) | (c) | (d) |
|---|---|---|---|---|
| Cyan | 0.45 | 0.52 | 0.59 | 0.70 |

*Cationic Polymer

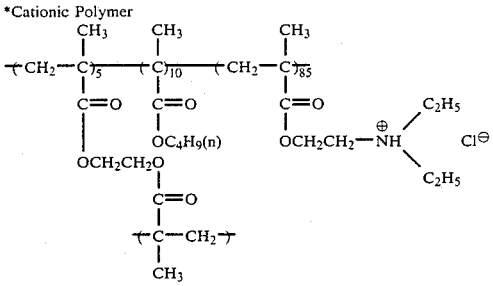

It should also be noted that in the backing layer of each sample (a) to (d) were incorporated the sodium salt of 2,4-dichloro-6-hydroxy-s-triazine as a hardener and sodium dodecylbenzenesulfonate as a coating aid in addition to the ingredients set forth in the foregoing Table 1.

Table 1 shows that the samples of the present invention (c) and (d) gained sufficient densities since the retouch dye spread well thereon.

EXAMPLE 2

Samples (e), (f), (g) and (h) having their respective backing layers as set forth in Table 2 were prepared in the same manner as in Example 1, and their retouchabilities were compared with one another in the same manner as in Example 1. As can be seen from Table 2, the samples of the present invention (g) and (h) were excellent in retouchability.

TABLE 2

| Sample | (e) | (f) | (g) | (h) |
|---|---|---|---|---|
| Gelatin | | | | |
| Sort | Lime-Processed Gelatin | Acid-Processed Gelatin | Acid-Processed Gelatin | Acid-Processed Gelatin |
| Isoelectric Point | 4.8 | 7.0 | 7.0 | 7.0 |
| Coverage (g/m$^2$) | 5.7 | 5.7 | 5.7 | 5.7 |
| Cationic Polymer* | | | | |
| Coverage (g/m$^2$) | 0 | 0 | 0.10 | 0.79 |
| Retouch Density | | | | |
| Yellow | 0.15 | 0.23 | 0.31 | 0.41 |
| Magenta | 0.08 | 0.16 | 0.22 | 0.30 |
| Cyan | 0.45 | 0.52 | 0.55 | 0.63 |

*Cationic Polymer

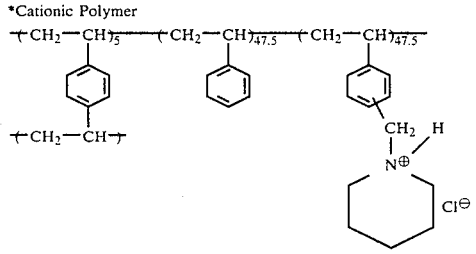

EXAMPLE 3

Sample (i) was prepared in the same manner as Sample (d) in Example 1 except that its backing layer had the following multilayer structure and individual layer compositions.

-continued

| | |
|---|---|
| First Backing Layer (support side) | |
| Acid-Processed Gelatin (isoelectric point: 7.0) | 2.5 g/m$^2$ |
| Cationic Polymer (the same one as in Example 1) | 0.40 g/m$^2$ |
| Tricresyl Phosphate | 0.10 g/m$^2$ |
| Second Backing Layer | |
| Acid-Processed Gelatin (isoelectric point: 7.0) | 2.5 g/m$^2$ |
| Cationic Polymer (the same one as in Example 1) | 0.40 g/m$^2$ |
| 1,2-Bis(vinylsulfonylacetoamido)ethane | 0.08 g/m$^2$ |
| Third Backing Layer | |
| Acid-Processed Gelatin (isoelectric point: 7.0) | 0.7 g/m$^2$ |
| Polymethylmethacrylate Fine Particles (3.0 μ) | 0.5 g/m$^2$ |
| 1,2-Bis(vinylsulfonylacetoamido)ethane | 0.01 g/m$^2$ |
| Sodium Dedecylbenzenesulfonate | 0.015 g/m$^2$ |

Retouchability of the thus obtained Sample (i) was tested in a similar manner as in Example 1. The results obtained showed a yellow density of 0.50, a magenta density of 0.41 and a cyan density of 0.72.

While the invention has been described in detail and with reference to specific embodiment thereof, it will be apparent to one skilled in the art that various changes and modifications can be made therein without departing from the spirit and scope thereof.

What is claimed is:

1. A silver halide color reversal photographic material which comprises a support having on the one side thereof a blue-sensitive silver halide emulsion layer, a green-sensitive silver halide emulsion layer and a red-sensitive silver halide emulsion layer, and on the other side thereof a gelatin-containing backing layer, said backing layer containing a gelatin of an isoelectric point of 5.5 or more and further containing a cationic polymer.

2. A silver halide color reversal photographic material as claimed in claim 1, wherein the gelatin is an acid-processed gelatin.

3. A silver halide color reversal photographic material as claimed in claim 1, wherein the isoelectric point of the gelatin is 6.5 or more.

4. A silver halide color reversal photographic material as claimed in claim 3, wherein the isoelectric point of the gelatin is in the range of 7.0 to 9.5.

5. A silver halide color reversal photographic material as claimed in claim 1, wherein the coverage of gelatin present in the backing layer is in the range of 2.0 to 20 g per square meter.

6. A silver halide color reversal photographic material as claimed in claim 5, wherein the coverage of gelatin is in the range of 4.0 to 15 g per square meter.

7. A silver halide color reversal photographic material as claimed in claim 1, wherein the cationic polymer has a pKa value of 5.0 or more.

8. A silver halide color reversal photographic material as claimed in claim 7, wherein the cationic polymer is polymers having the recurring units represented by the following general formula (I):

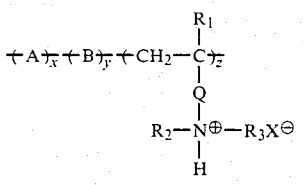

wherein A represents a monomer unit obtained by copolymerizing copolymerizable monomer having at least two copolymerizable ethylenically unsaturated groups wherein at least one of the groups forms a side chain of the monomer; B represents a monomer unit obtained by copolymerizing copolymerizable ethylenically unsaturated monomers; Q represents an alkylene group containing 1 to 12 carbon atoms, a phenylene group, an aralkylene group containing 7 to 12 carbon atoms or a group of formula:

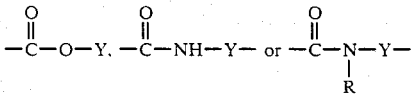

(wherein Y represents an alkylene group containing 1 to 6 carbon atoms or an aralkylene group containing 7 to 12 carbon atoms; and R represent an alkyl group containing 1 to 6 carbon atoms); $R_1$ represents a hydrogen atom or a lower alkyl group containing 1 to 6 carbon atoms; $R_2$ and $R_3$, which may be the same or different, each represents an unsubstituted or substituted alkyl group containing 1 to 20 carbon atoms or an unsubstituted or substituted aralkyl group containing 7 to 20 carbon atoms, or they combine with each other to form a 5- or 6-membered ring structure together with the nitrogen atom; $X\ominus$ represents an anion; and x represents 0 to 10 mole %, y represents 0 to 60 mole % and z represents 30 to 99.5 mole %.

9. A silver halide color reversal photographic material as claimed in claim 7, wherein the cationic polymer is polymers, having the recurring units represented by the following general formula (II):

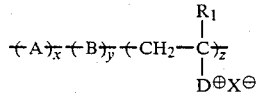

wherein A represents a monomer unit obtained by copolymerizing copolymerizable monomers having at least two copolymerizable ethylenically unsaturated groups wherein at least one of the groups forms a side chain of the monomer; B represents a monomer unit obtained by copolymerizing copolymerizable ethylenically unsaturated monomers; $R_1$ represents a hydrogen atom or a lower alkyl group containing 1 to 6 carbon atoms; $D\oplus$ represents a 5- or 6-membered heterocyclic group containing one or two nitrogen atoms wherein the nitrogen atom is charged positively; $X\ominus$ represents an anion; and x represents 0 to 10 mole %, y represents 0 to 60 mole % and z represents 30 to 99.5 mole %.

10. A silver halide color reversal photographic material as claimed in claim 1, wherein the cationic polymer is in an amount in the range of 0.01 to 10 g per square meter.

11. A silver halide color reversal photographic material as claimed in claim 10, wherein the cationic polymer is in an amount in the range of 0.05 to 5 g per square meter.

12. A silver halide color reversal photographic material as claimed in claim 11, wherein the cationic polymer is in an amount in the range of 0.1 to 2 g per square meter.

13. A silver halide color reversal photographic material as claimed in claim 1, wherein the backing layer is further comprised of a high boiling point organic solvent.

14. A silver halide color reversal photographic material as claimed in claim 13, wherein the high boiling point organic solvent is selected from the group consisting of alkyl esters of phthalic acid, phosphoric acid esters, citric acid esters, benzoic acid esters, alkyl amides, fatty acid esters and trimesic acid esters.

15. A silver halide color reversal photographic material as claimed in claim 14, wherein the high boiling point organic solvent is in an amount in the range of 0.01 to 0.40 g per square meter.

16. A silver halide color reversal photographic material as claimed in claim 15, wherein the high boiling point organic solvent is in an amount in the range of 0.05 to 0.30 g per square meter.

17. A silver halide color reversal photographic material as claimed in claim 1, wherein the backing layer is constructed of plural layers.

18. A silver halide color reversal photographic material as claimed in claim 1, wherein the blue-sensitive silver halide emulsion layer, the green-sensitive silver halide emulsion layer and the red-sensitive silver halide emulsion layer comprise a yellow coupler, a magenta coupler and cyan coupler respectively.

19. A method of retouching silver halide color reversal photographic materials which comprises developing a silver halide color photographic material comprising a support having on the one side thereof a blue-sensitive silver halide emulsion layer, a green-sensitive silver halide emulsion layer and a red-sensitive silver halide emulsion layer and on the other side thereof a gelatin-containing backing layer said backing layer containing a gelatin of an isoelectric point of 5.5 or more and further containing a cation polymer and then retouching the developed silver halide color photographic material from the side of backing layer thereof by means of water soluble anionic dyes.

* * * * *